US009816326B2

(12) United States Patent
Miller et al.

(10) Patent No.: US 9,816,326 B2
(45) Date of Patent: Nov. 14, 2017

(54) MISALIGNMENT-TOLERANT WELLSITE CONNECTION ASSEMBLY, SYSTEM, AND METHOD

(71) Applicant: National Oilwell Varco, L.P., Houston, TX (US)

(72) Inventors: Travis James Miller, Cypress, TX (US); Kent Allen Grebing, Spring, TX (US); Michael Edwin Pollard, Houston, TX (US); Frank Benjamin Springett, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 747 days.

(21) Appl. No.: 13/857,088

(22) Filed: Apr. 4, 2013

(65) Prior Publication Data

US 2013/0264070 A1 Oct. 10, 2013

Related U.S. Application Data

(60) Provisional application No. 61/620,346, filed on Apr. 4, 2012.

(51) Int. Cl.
*E21B 33/038* (2006.01)
*E21B 17/02* (2006.01)

(52) U.S. Cl.
CPC ..... *E21B 17/02* (2013.01); *E21B 33/038* (2013.01)

(58) Field of Classification Search
CPC ..... E21B 17/02; E21B 33/038; E21B 33/064; F16L 1/26; F16L 27/00
See application file for complete search history.

(56) References Cited

U.S. PATENT DOCUMENTS 2,265,267 A * 12/1941 Cowles ..... F16L 37/113 251/149.6
2,410,589 A * 11/1946 Segelhorst ..... E21B 19/10 166/75.14

(Continued)

FOREIGN PATENT DOCUMENTS

CN 202064876 12/2011
GB 2406151 3/2005

(Continued)

OTHER PUBLICATIONS

Invitation to Pay Additional Fees and, Where Applicable , Protest Fee for PCT Patent Application No. PCT/US2013/035332 dated Mar. 28, 2014, 5 pages.

(Continued)

*Primary Examiner* — Kipp Wallace
(74) *Attorney, Agent, or Firm* — Conley Rose, P.C.

(57) ABSTRACT

A connection assembly, system and method for connecting components of a wellsite are provided. The wellsite has a wellbore extending into a subsurface formation, the connection assembly includes a female connector having a cavity extending therein, a floating cartridge having, and a male connector. The female connector or floating cartridge is operatively connectable to a first of the components. The floating cartridge is operatively connectable to the female connector and laterally movable therein. The male connector is receivable in the cavity and is operatively connectable to the second of the components and the floating cartridge such that the male connector and the female connector are movably positionable relative to each other by the floating cartridge whereby a misalignment between the wellsite components is tolerated. The male connector may have a joint pivotally connectable to the floating cartridge.

21 Claims, 9 Drawing Sheets

(56) References Cited

U.S. PATENT DOCUMENTS

| | | | | |
|---|---|---|---|---|
| 2,609,836 | A | 9/1952 | Knox | |
| 3,244,424 | A * | 4/1966 | Cope | F16J 15/56 277/323 |
| 3,485,051 | A | 12/1969 | Watkins | |
| 3,667,721 | A | 6/1972 | Vujasinovic | |
| 4,310,139 | A | 1/1982 | Williams, III et al. | |
| 4,431,215 | A | 2/1984 | Moyer | |
| 4,460,047 | A * | 7/1984 | Pokladnik | E21B 33/035 166/341 |
| 4,479,506 | A | 10/1984 | Goans | |
| 4,557,508 | A | 12/1985 | Walker | |
| 4,606,557 | A | 8/1986 | Coffey | |
| 4,630,680 | A | 12/1986 | Elkins | |
| 4,659,114 | A * | 4/1987 | Gerber | F16L 27/125 285/11 |
| 4,708,376 | A | 11/1987 | Jennings et al. | |
| 4,709,726 | A * | 12/1987 | Fitzgibbons | E21B 33/038 137/614.04 |
| 4,902,044 | A | 2/1990 | Williams et al. | |
| 4,904,228 | A | 2/1990 | Frear et al. | |
| 5,178,215 | A | 1/1993 | Yenulis et al. | |
| 5,286,063 | A * | 2/1994 | Huston | F16L 27/00 277/409 |
| 5,305,838 | A | 4/1994 | Pauc | |
| 5,332,043 | A | 7/1994 | Ferguson | |
| 5,507,467 | A | 4/1996 | Mott | |
| 5,588,491 | A | 12/1996 | Brugman et al. | |
| 5,662,171 | A | 9/1997 | Brugman et al. | |
| 5,803,169 | A * | 9/1998 | Bassinger | E21B 33/068 166/84.1 |
| 5,971,076 | A | 10/1999 | Taylor et al. | |
| 6,016,880 | A | 1/2000 | Hall et al. | |
| 6,089,321 | A | 7/2000 | Morrill | |
| 6,129,149 | A | 10/2000 | Beall | |
| 6,609,572 | B1 | 8/2003 | Andersen et al. | |
| 6,663,144 | B1 * | 12/2003 | Smith, III | E21B 33/038 285/110 |
| 6,966,382 | B2 | 11/2005 | Buckle et al. | |
| 7,954,859 | B2 * | 6/2011 | Smith, III | F16L 1/26 137/614.04 |
| 8,016,042 | B2 | 9/2011 | Spiering et al. | |
| 8,313,105 | B2 * | 11/2012 | Smith, III | F16L 1/26 137/614.04 |
| 2003/0106693 | A1 | 6/2003 | Jennings et al. | |
| 2003/0151254 | A1 | 8/2003 | Baugh | |
| 2004/0102069 | A1 | 5/2004 | Singeetham et al. | |
| 2004/0256096 | A1 * | 12/2004 | Adams | E21B 17/085 166/85.1 |
| 2005/0034870 | A1 | 2/2005 | Buckle et al. | |
| 2005/0057040 | A1 * | 3/2005 | Smith | F16L 17/02 285/108 |
| 2005/0269102 | A1 | 12/2005 | McCanna | |
| 2006/0197339 | A1 | 9/2006 | Oestergaard et al. | |
| 2009/0014184 | A1 | 1/2009 | Voss et al. | |
| 2010/0006298 | A1 | 1/2010 | Voss et al. | |
| 2010/0078174 | A1 | 4/2010 | Spiering et al. | |
| 2010/0155074 | A1 | 6/2010 | Rodriguez | |
| 2013/0175055 | A1 | 7/2013 | Hart et al. | |

FOREIGN PATENT DOCUMENTS

| | | |
|---|---|---|
| GB | 2460927 A | 12/2009 |
| WO | 2013098560 | 7/2013 |

OTHER PUBLICATIONS

International Search Report for PCT Patent Application No. PCT/US2013/035332 dated Jun. 3, 2014, 7 pages.
International Search Report for PCT Patent Application No. PCT/US2013/035280 dated Mar. 28, 2014, 4 pages.
International Search Report for PCT Patent Application No. PCT/US2013/035269 dated Mar. 28, 2014, 5 pages.
Akers, T.J., et al., "Formation and Removal of Hydrates inside wellhead Connectors", SPE 124409, SPE Annual Technical Conference and Exhibition held in New Orleans, Oct. 1, 2009, 15 pages.
Canadian First Office Action dated Nov. 16, 2015 for Canadian Application No. 2,868,811, 3 pages.
Singapore Search Report and Written Opinion dated Oct. 13, 2015 for Singapore Application No. 11201406309U, 12 pages.
GE Oil & Gas product brochure "VetcoGray Subsea Wellhead Systems" (2009) 12 pages.
VetcoGray product brochure "H-4 Subsea Connectors" (2008) 7 pages.
GE Oil & Gas product brochure "Hydril Pressure Control GX® Annular Blowout Preventer" (2010) 2 pages.
Cooper Cameron Corporation, Cameron Division product brochure "Collect Connector Comparison" (Jun. 1999) 8 pages.
Dril-Quip, Inc. product brochure DX® Series Subsea Connectors (2008) 8 pages.
GE Oil & Gas product brochure "Hydril Pressure Control Annu-Flex TM" (2010) 2 pages.
GE Oil & Gas product brochure "Hydril Pressure Control GK® Annular Blowout Preventer" (2010) 2 pages.
GE Oil & Gas product brochure "Hydril Pressure Control GL® Annular Blowout Preventer" (2010) 2 pages.
T3 Energy Services product brochure "7022 Annular BOP" (date unknown but prior to the date of this application) 1 pages.
T3 Energy Services product brochure "7072 BOPS" (date unknown but prior to the date of this application) 1 pages.
T3 Energy Services product brochure "7082 BOPS" (date unknown but prior to the date of this application) 1 page.
First Office Action for Chinese Patent Application No. 201380023484.5 dated May 3, 2016, 19 pages.
Written Opinion for Singapore Patent Application No. 11201406309U dated May 16, 2016, 4 pages.
Second Office Action dated Dec. 5, 2016, for Chinese patent application No. 201380023484.5 (10 pages).
Third Written Opinion dated Jan. 6, 2017, for Singapore patent application No. 11201406309U (4 pages).

* cited by examiner

MISALIGNMENT-TOLERANT WELLSITE CONNECTION ASSEMBLY, SYSTEM, AND METHOD

BACKGROUND

This present disclosure relates generally to connectors used in wellsite operations. More specifically, the present disclosure relates to connection assemblies, such as wellhead and/or subsea connectors, and other apparatus and methods for connecting wellsite components, such as drilling components and/or choke and kill systems.

Various oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars (or tubular strings) may be provided for passing subsurface fluids to the surface.

A wellhead may be provided about a top of the wellbore for supporting casings and/or tubulars in the wellbore. A wellhead connector may be provided for connecting the wellhead to surface components, such as a blowout preventer (BOP) and/or a Christmas tree. In some wells, a tubular wellhead is located on the sea floor. During drilling operations, a riser extends from a vessel at the surface down to the wellhead. A wellhead connector connects the lower end of the riser to the wellhead. A wellhead connector may also be used to connect a subsea production tree to the wellhead.

Connectors may be used in subsea applications. Subsea connectors are used to join subsea devices in a subsea stack. If gas from the seabed migrates into a subsea connector, under the right conditions, the gas can form hydrates, which are solids of hydrocarbon gases and water, inside the connector. The hydrates may build up in the connector to an extent that they interfere with operation of the latching mechanism of the connector. To avoid or control hydrate buildup in the connector, a hydrate seal may be used to prevent or control migration of gas into the connector. Some examples of connectors are provided in U.S. Pat./Application Nos. 4,557,508; 8,016,042; 7,614,453; 4,902,044; 2010/0006298; 4,606,555; 4,606,555 and 5,332,043.

SUMMARY

In at least one aspect, the techniques herein may relate to a connection assembly for connecting components of a wellsite. The wellsite has a wellbore extending into a subsurface formation. The connection assembly includes a female connector having an end operatively connectable to a first of the components and a cavity extending therein, a floating cartridge positionable in the cavity of the female connector and laterally movable therein, and a male connector operatively connectable to a second of the components. The male connector is receivable in the cavity of the female connector and operatively connectable to the floating cartridge such that the male connector and the female connector are movably positionable relative to each other by the floating cartridge whereby a misalignment between the wellsite components is tolerated.

The female connector may include a housing having a bore therethrough in communication with the first of the components. The housing may include an upper housing and a lower housing having an interface therebetween. The floating cartridge is positionable in one of the upper and lower housings. The male connector has a bore therethrough in fluid communication with the second of the components. The female connector has a bore therethrough in fluid communication with the first of the components and the bore of the male connector.

The connection assembly may also include a wear insert positionable in the female connector. The wear insert has a bore therethrough in fluid communication with the bore of the female connector and the bore of the male connector. The wear insert is positioned between the upper housing and the floating cartridge. The floating cartridge has an outer diameter smaller than an inner diameter of the lower housing. The male connector has an outer diameter positionable adjacent an inner diameter of the floating cartridge. Opposite ends of the floating cartridge are positionable in the cavity of the female connector and against an inner wall of the female connector to restrict axial movement thereof. An end of the floating cartridge is positionable against a wear insert in the female connector to restrict axial movement thereof. The connection assembly may also include at least one seal. One of the female connector or an end of the male connector is fixed, and another of the female connector and an end of the male connector is movable.

In another aspect, the disclosure relates to a wellsite system for connecting components of a wellsite. The system includes a first wellsite component, a second wellsite component, and the connection assembly. The wellsite components include choke and kill lines, a low marine riser pump, a blowout preventer, a riser and combinations thereof.

In yet another aspect, the disclosure relates to a method of connecting components of a wellsite. The method involves providing the connection assembly, operatively connecting the end of the female connector to the first of the components and the male connector to the second of the components, operatively connecting an end of the male connector to the floating cartridge in the female connector, and movably positioning the male connector and the female connector relative to each other by movement of the floating cartridge whereby a misalignment between the wellsite components is tolerated.

The method may also involve preventing wear by positioning the wear insert in the cavity of the female connector, or providing at least one seal about one of the female connector, the male connector, the floating cartridge and combinations thereof.

In another aspect, the disclosure relates to a connection assembly for connecting components of a wellsite. The connection assembly includes a female connector having a cavity extending therein, a floating cartridge having an end operatively connectable to a first of the components, the floating cartridge operatively connectable to the female connector and laterally movable therein, and a male connector. The male connector includes a pivoting joint having a component end operatively connectable to the second of the components and a cartridge end operatively connectable to the floating cartridge to provide pivotal movement therebetween such that the male connector and the female connector are movably positionable relative to each other whereby a misalignment between the wellsite components is tolerated.

The male connector and the female connector may each have bores therethrough in fluid communication with the first and second components. The female connector may include a female housing and the male connector includes a male housing. The male housing may be operatively connectable to the female housing, and the male housing may have the joint and a portion of the floating cartridge therein.

The joint has a passage therethrough in fluid communication with the first and second components. The floating cartridge includes a piston ring slidably positionable in a piston chamber of the female connector. The piston chamber has walls restricting axial movement of the floating cartridge. The floating cartridge has a cavity therein to pivotally receive the cartridge end of the joint. The male connector may include a male housing operatively connectable to the second component, and the housing may have a joint cavity therein to pivotally receive the component end of the joint.

The joint may include a fixed socket and a pivotal sphere at each of the component end and the cartridge end. The joint may include a pivoting channel extending between the cartridge end and the component end. The pivoting channel has a bore therethrough in fluid communication with the first and the second components. The connection assembly may also include at least one seal. The female connector or an end of the male connector is fixed, and another of the female connector or an end of the male connector is movable.

In yet another aspect, the disclosure relates to a wellsite system for connecting components of a wellsite. The system includes a first wellsite component, a second wellsite component, and the connection assembly. The wellsite components may include choke and kill lines, a low marine riser pump, a blowout preventer, a riser and combinations thereof.

Finally, in another aspect, the disclosure relates to a method of connecting components of a wellsite. The method involves providing the connection assembly, operatively connecting the end of the floating cartridge to the first of the components and to the female connector, operatively connecting the male connector to the second of the components and the joint of the male connector to the floating cartridge, and movably positioning the male connector and the female connector relative to each other by movement of the floating cartridge whereby a misalignment between the wellsite components is tolerated. This may also involve providing at least one seal about one of the female connector, the male connector, the floating cartridge and combinations thereof.

In one embodiment, an apparatus includes a male stab connector and a female receiver connector to receive and connect to the male stab connector. The apparatus further comprises a connection mechanism to enable the male stab connector to connect to the female receiver connector even in situations where the male stab connector is not exactly aligned with the female receiver connector.

In another aspect of the disclosure, a system in accordance with the disclosure includes first and second drilling components. The first drilling component includes a male stab connector attached thereto. The second drilling component includes a female receiver connector attached thereto. The female receiver connector is configured to receive and connect to the male stab connector. The system further includes a connection mechanism to enable the male stab connector to connect to the female receiver connector even in situations where the male stab connector is not exactly aligned with the female receiver connector.

The foregoing general description and the following detailed description are exemplary of the disclosure and are intended to provide an overview or framework for understanding the nature and character of the disclosure as claimed. The accompanying drawings are included to provide a further understanding of the disclosure and are incorporated in and constitute a part of this specification. The drawings illustrate various embodiments of the disclosure and together with the description serve to explain the principles and operation of the disclosure.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

DETAILED DESCRIPTION

It will be readily understood that the components of the present disclosure, as generally described and illustrated in the Figures herein, could be arranged and designed in a wide variety of different configurations. Thus, the following more detailed description of the embodiments of the disclosure, as represented in the Figures, is not intended to limit the scope of the disclosure, but is merely representative of certain examples of presently contemplated embodiments in accordance with the disclosure.

Flexible connectors for connecting drilling equipment such as choke and kill systems and other systems are provided. The present disclosure has been developed to provide apparatus and methods to reliably connect multiple drilling components. A subsea blowout preventer (BOP) stack may include two major components: a Lower Marine Riser Package (LMRP) and a Lower Stack. These components may be joined together to work as a unified system. However, they may be periodically separated with the LMRP returning to the surface for maintenance operations and the Lower Stack remaining subsea on the wellhead. The reuniting of these items subsea may be relatively difficult, and new customer needs may require more than one LMRP mating to a single Lower Stack. The rigidity of connectors may be needed to connect choke and kill systems and other systems on the LMRP and Lower Stack. That is, it can be difficult to align the connectors of choke and kill systems and other systems when an LMRP is mated to a Lower Stack.

Choke and kill systems may include rigid high-pressure piping that runs adjacent to the main wellbore. A high pressure "stab" may be provided to connect the LMRP's choke and kill circuit to the Lower Stack's choke and kill circuit. Choke and kill stabs, acoustic stabs, and other types of separable high and low pressure connections may be rigid and may include the following: (1) a male stab that is rigidly bolted or fastened directly or indirectly to the structure of the connection, such as to the Lower Stack; and (2) a female receiver to receive the male stab, wherein the female receiver contains sealing elements to create a seal with the male stab and the female receiver is rigidly bolted or fastened directly or indirectly to the structure of the connection, such as to the LMRP.

Aligning the male stab with the female receiver can be difficult, where the seal tolerances and clearances between the inside diameter (ID) of the female receiver and the outside diameter (OD) of the male stab are quite small (on the order of about thousandths of an inch or cm). The end result may be that these types of connections may be (1) relatively difficult to stab since there may be little "play" in the connections; and (2) high wear items because the small clearances mean that in order to align the male stab and female receiver, there may be a required amount of ID/OD physical interaction.

Figure 1:
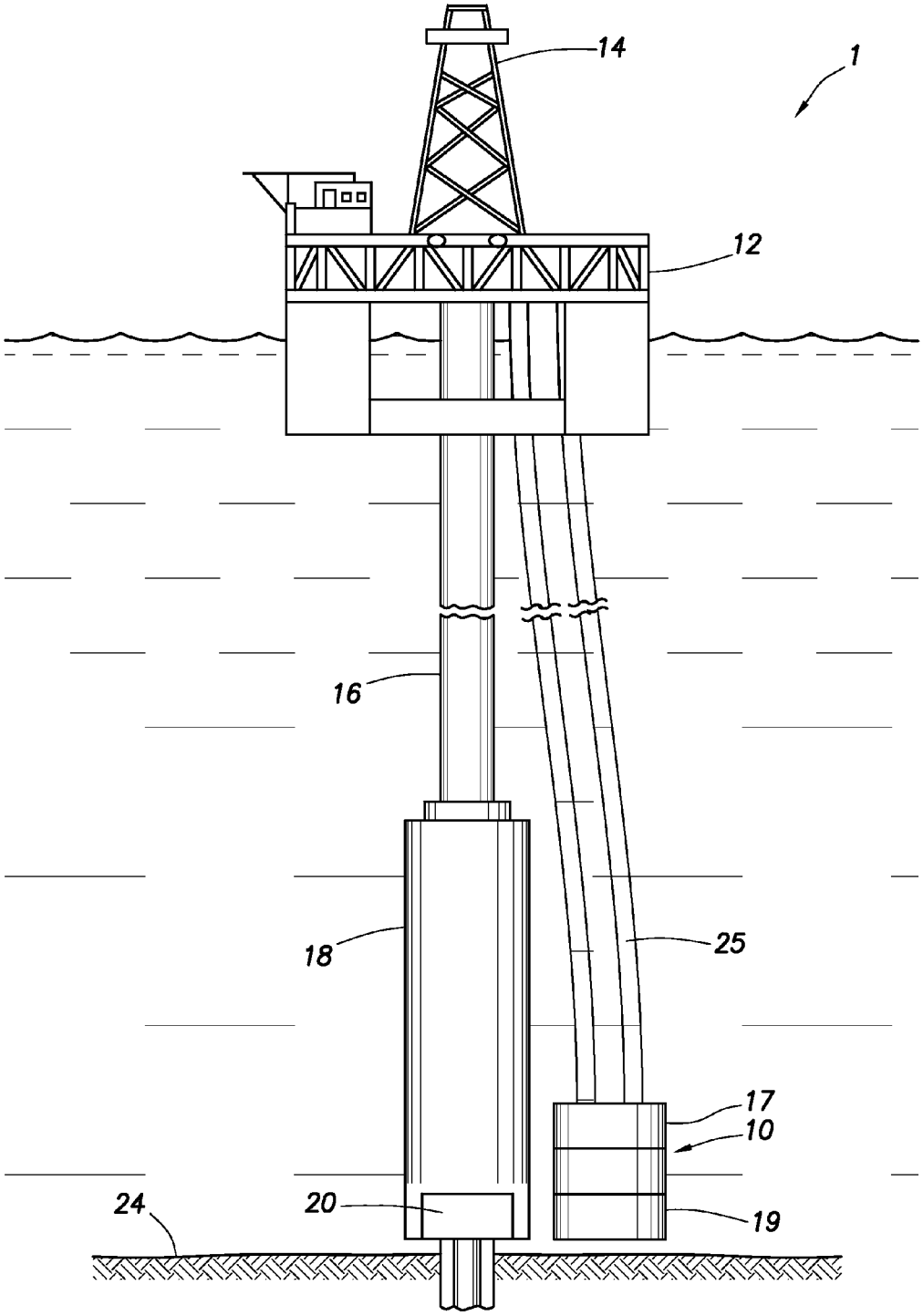
FIG. 1 is a schematic view of an offshore wellsite having a connection assembly connecting various components.

FIG. 1 shows an example wellsite 1 depicting an environment in which a connection assembly 10 may be used. The wellsite includes a platform 12, with a rig 14 and a riser 16 extending therebelow. The riser 16 connects to a subsea system 18 which may include, for example, a low marine riser package, blowout preventer, mandrel, lower stack, and/or other features. The subsea system 18 is connected to a wellhead 20 extending into a wellbore 22 in sea floor 24.

The connection assembly 10 is connected to the subsea system 18 for operation therewith. The connection assembly 10 is also linked via choke & kill lines 25 and associated components to the platform 12. In the example shown, the connection assembly 10 is connected to an LMRP 17 and to a Lower Stack 19. While the connection assembly 10 is depicted as being used with a choke & kill operation, the connection assembly 10 may be used with a variety of wellsite components to provide a connection therebetween in the presence (or absence) of misalignments. For example, the connectors herein may be land-based or subsea connectors for connecting various wellsite components, such as a tubular, a casing, a riser, a wellhead, a blowout preventer, a low marine riser pump (LMRP), etc. Other applications, including applications inside and outside of the downhole drilling industry, are possible and within the scope of the disclosure.

FIGS. 2A-3B depict embodiments of the connection assembly 10. In each of these figures, the connection assembly 10 includes a female receiving connector 100, 100' with a floating cartridge 104, 104' slidably movable therein. A male receiving connector 110 is receivable by the floating cartridge 104,104' and the female receiving connector 100. The female receiving connector 100, 100' and the male receiving connector 110 are movable relative to each other via the floating cartridge 104, 104'. In this manner, the components connected to the female receiving connector 100 and the male receiving connector 110 may be movable therewith to permit misalignment therebetween.

Figure 2A:
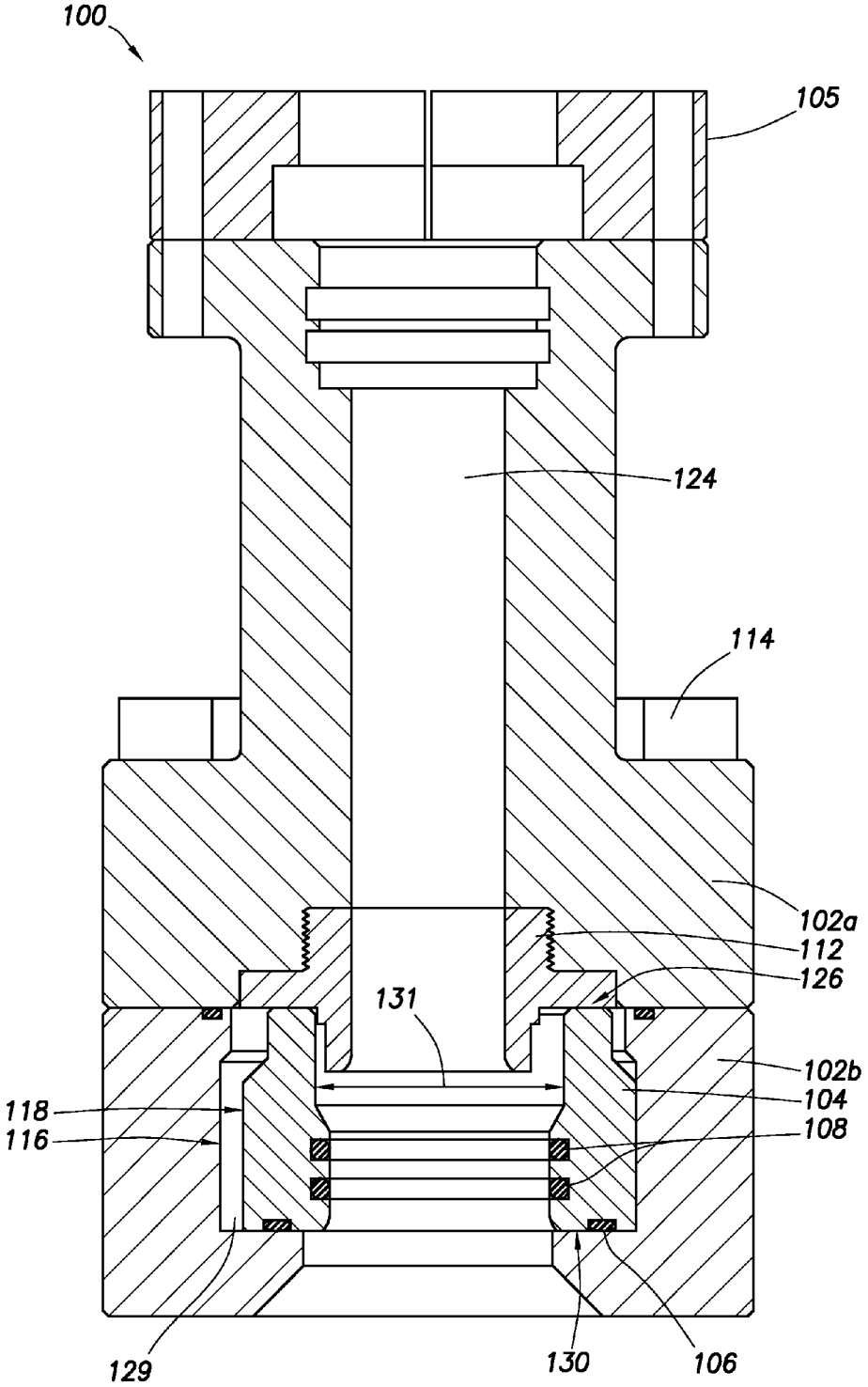
FIG. 2A is a cross-sectional side view of an embodiment of a female receiving connector in accordance with the invention.
Figure 2B:
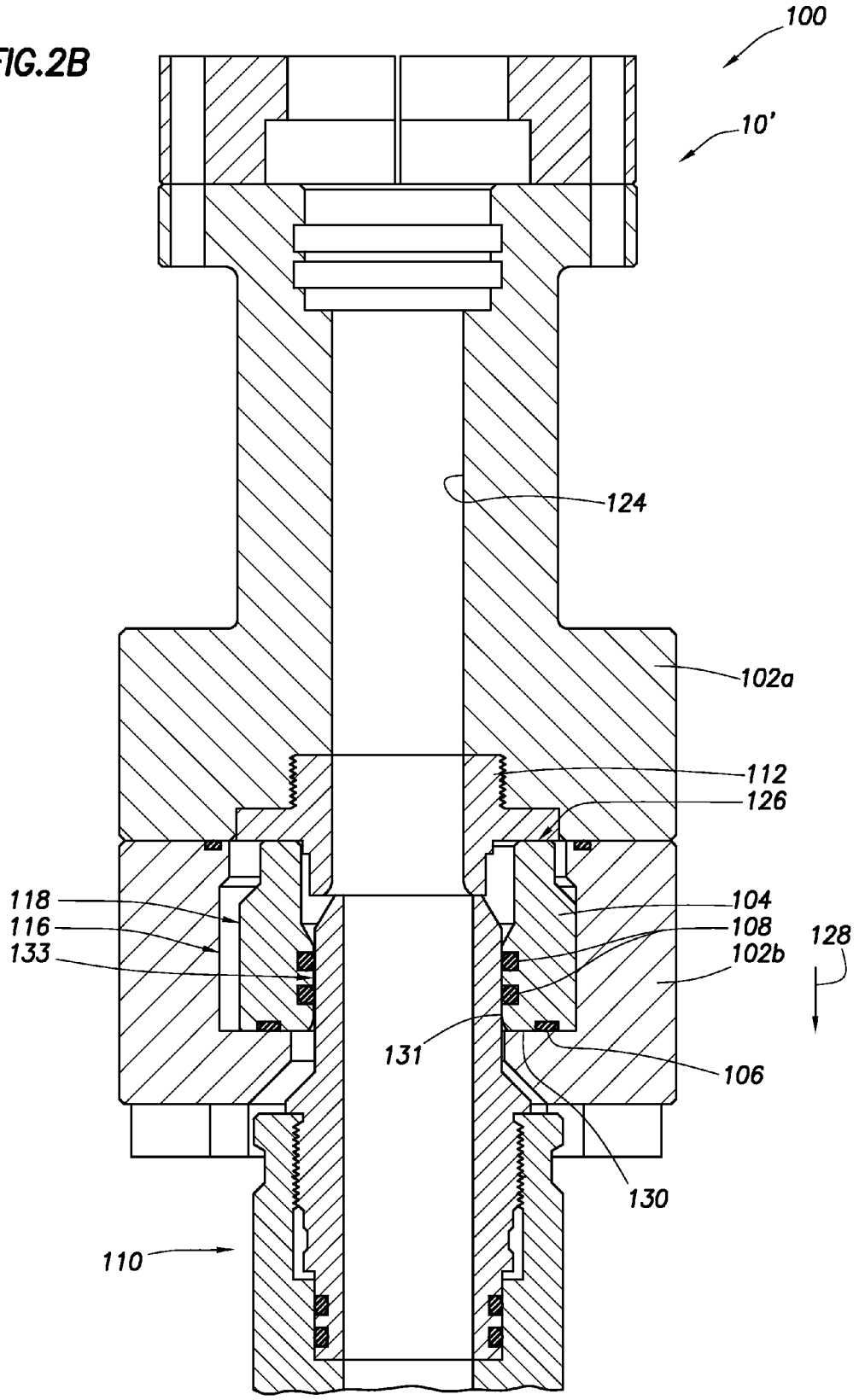
FIG. 2B is a cross-sectional view of the female receiving connector of FIG. 2A mated to a male stab connector in accordance with the invention.
Figure 2C:
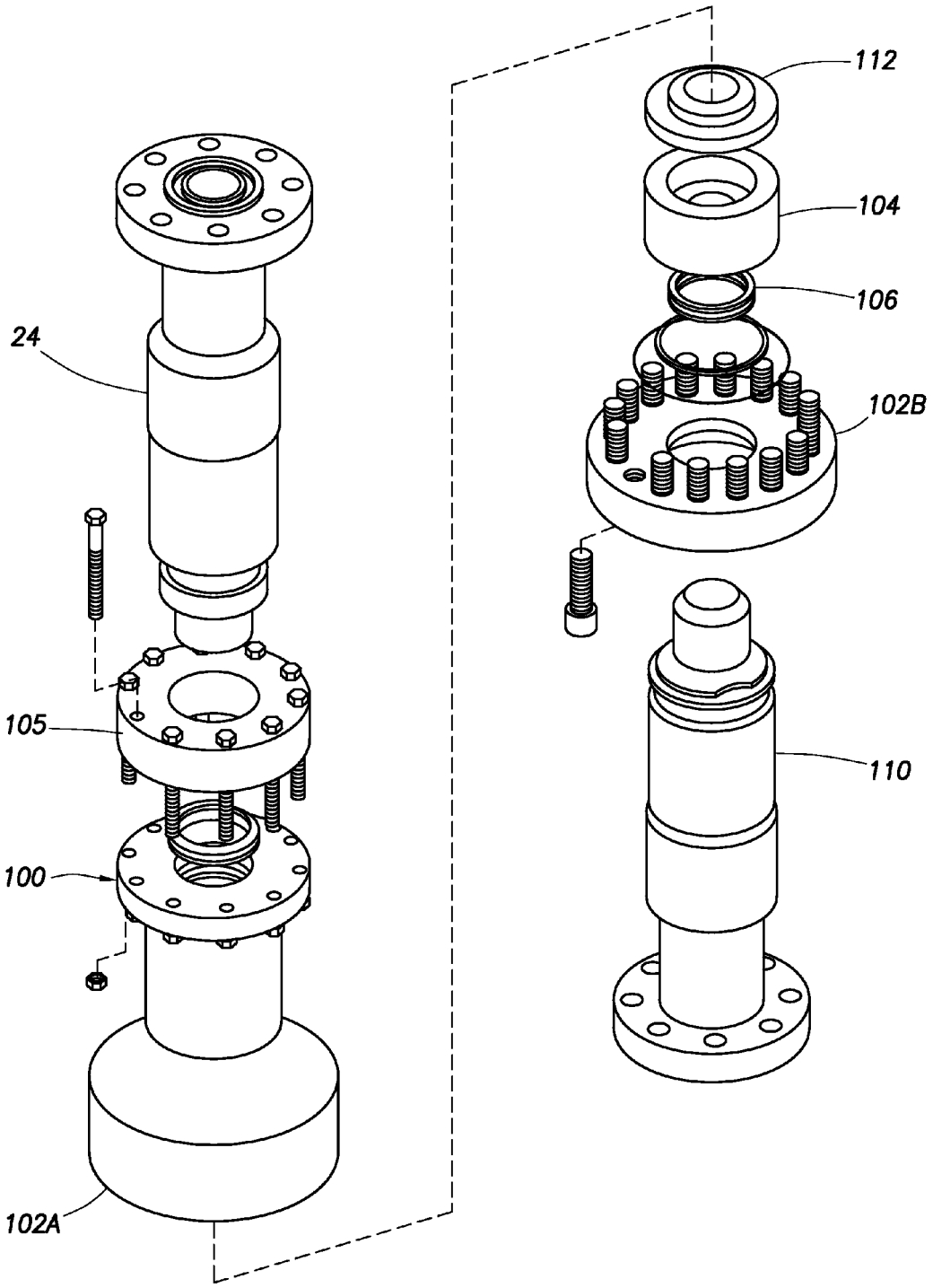
FIG. 2C is an exploded view of the female receiving connector and mated male stab connector of FIG. 2B.

Referring to FIGS. 2A-2C, an embodiment of a female connector 100 is provided. FIG. 2A depicts a cross-sectional, side view of an embodiment of a female receiving connector 100 in accordance with the disclosure. Such a female receiving connector 100 may receive and connect to a male stab connector 110, an example of which is shown in FIG. 2B. In an embodiment, the female receiving connector 100 is connected to an LMRP and the male stab connector 110 is connected to a Lower Stack, although this could be reversed in other embodiments. Similarly, the female receiving connector 100 and the male stab connector 110 may be used to connect an LMRP's choke & kill circuit to a Lower Stack's choke and & kill circuit, although the connectors 100, 110 are not limited to this application.

As shown, the female receiving connector 100 includes a housing 102, in this example having a two-part housing 102*a*, 102*b*, that may be rigidly attached to or part of a structure, such as an LMRP or Lower Stack. In one embodiment, the upper housing part (or cover) 102*a* and lower housing part (or sub) 102*b* are held together by bolts 114 or other suitable fasteners 114. A clamp 105 may optionally be provided. An interface 126 is defined between the upper and lower housings 102*a,b*. The housing parts 102*a*,102*b* may be connected to various components, such as the LRMP and Lower Stack for operative connection thereof.

The floating cartridge (or piston) 104 may reside within a cavity 129 formed by the housing parts 102*a*, 102*b* when the housing parts 102*a*, 102*b* are fastened together. As shown, an inside diameter 116 of the housing 102 may be substantially larger than an outside diameter 118 of the floating cartridge 104 and define a cavity 129 for receiving the floating cartridge 104. This may allow the floating cartridge 104 to slide axially and/or laterally within the housing 102 within the bounds of the outside diameter 116. An interface 130 is provided between the floating cartridge 104 and the lower housing 102*b*. The floating cartridge 104 may be positioned between the upper and lower housings 102*a,b* to restrict axial motion therebetween and/or to restrict motion to lateral movement in cavity 129.

A face seal 106 on the floating cartridge 104 may contact and seal against a corresponding seal surface 120 of the housing 102 as the floating cartridge 104 moves inside the housing 102. One or more stab seals 108 may seal against a male stab connector 110, the likes of which will be discussed in more detail in association with FIGS. 2B and 2C. One or more seals may be provided about the connectors 100, 110 to provide fluid sealing capabilities about the various connected components.

FIGS. 2B and 2C depict cross-sectional and exploded views of the female connector 100 and the male stab connector 110 connected together. An inside diameter 131 of the floating cartridge 104 may be configured to receive a male stab connector 110. In certain embodiments, the clearance between the inside diameter 131 of the floating cartridge 104 and an outside diameter 133 of the male stab connector 110 is very small, such as on the order of about several thousandths of inches or cm. In such embodiments, a small angular misalignment between the floating cartridge 104 and the male stab connector 110 may be tolerated when mating the male stab connector 110 with the floating cartridge 104.

By contrast, the lateral movement of the floating cartridge 104 within the housing 102 may accommodate significant axial misalignment (possibly up to about an inch (2.54 cm) or more) between the male stab connector 110 and the female receiving connector 100. That is, in the event the male stab connector 110 is misaligned with the female receiving connector 100 when attempting to connect them together, the floating cartridge 104 may migrate laterally relative to the housing 102 of the female receiving connector 100 to align itself with the male stab connector 110. The amount of axial misalignment that can be tolerated may depend on the size of the cavity 129 relative to the size of the floating cartridge 104.

In a given example, the male stab connector 110 may be fixed, and the female receiving connector 100 may be movable relative thereto as indicated by the arrows, and the reverse is also possible. The bore 124 may permit the passage of fluid through the connection assembly 10. The bore 124 may be in fluid communication with components connected to the male and/or female connectors 100, 110 for the passage of fluid therethrough.

In certain embodiments, the face seal 106 may be designed to be "self-energized" by hydraulic pressure within a central bore 124 extending through the housing 102. The central bore 124 may provide fluid communication between the components connected by the connectors 100, 110 for the passage of fluid therethrough. Because the pressure in the central bore 124 may be higher than pressure outside of the central bore 124, a pressure differential may exist that improves the sealing ability of the face seal 106. More specifically, pressure inside the central bore 124 may work its way into the interface 126 (where no seal may be present) to create a force that urges the floating cartridge 104 against the housing part 102*b* in direction 128. This may reduce any gap that is present at the interface 130, thereby improving the sealing ability of the face seal 106. In one example, such as in underwater applications, pressure inside the central bore 124 may be on the order of about 15,000 psi (1054.9 kg/cm) while pressure external to the female receiving connector 100 may be on the order of about 5,000 psi (351.62 kg/cm). This pressure differential may push the floating cartridge 104 in the direction 128 since the force exerted by the internal pressure may exceed the force exerted in the opposite direction by the external pressure.

In certain embodiments, a wear insert 112 may be provided in the female receiving connector 100 to extend the usable life of the female receiving connector 100. An upper end of the floating cartridge 104 may be positioned between the wear insert 112 and the interface 130. The wear insert 112 may be placed in a location that receives significant wear, such as wear from abrasive fluids travelling through the central bore 124. The wear insert 112 may be removed and replaced when it is sufficiently worn. The wear insert 112 is optional and may be deleted in certain embodiments. Similarly, in other embodiments, a wear insert may be incorporated into the male stab connector 110 to extend the usable life of the male stab connector 110.

Although the floating cartridge 104 described in association with FIGS. 2A through 2C is shown in the female receiving connector 100, it is also contemplated that such a floating cartridge 104 or other floating element could be incorporated into a male stab connector 110 in accordance with the disclosure. That is, a male stab connector 110 could include a fixed portion, which is rigidly fastened to a structure such as an LMRP or Lower Stack, and a moveable portion that moves laterally and/or angularly relative to the fixed portion to accommodate misalignment between the male stab connector 110 and a female receiving connector 100. In other embodiments, both the female receiving connector 100 and the male stab connector 110 could include fixed portions and moveable portions to accommodate misalignment therebetween.

Figure 3A:
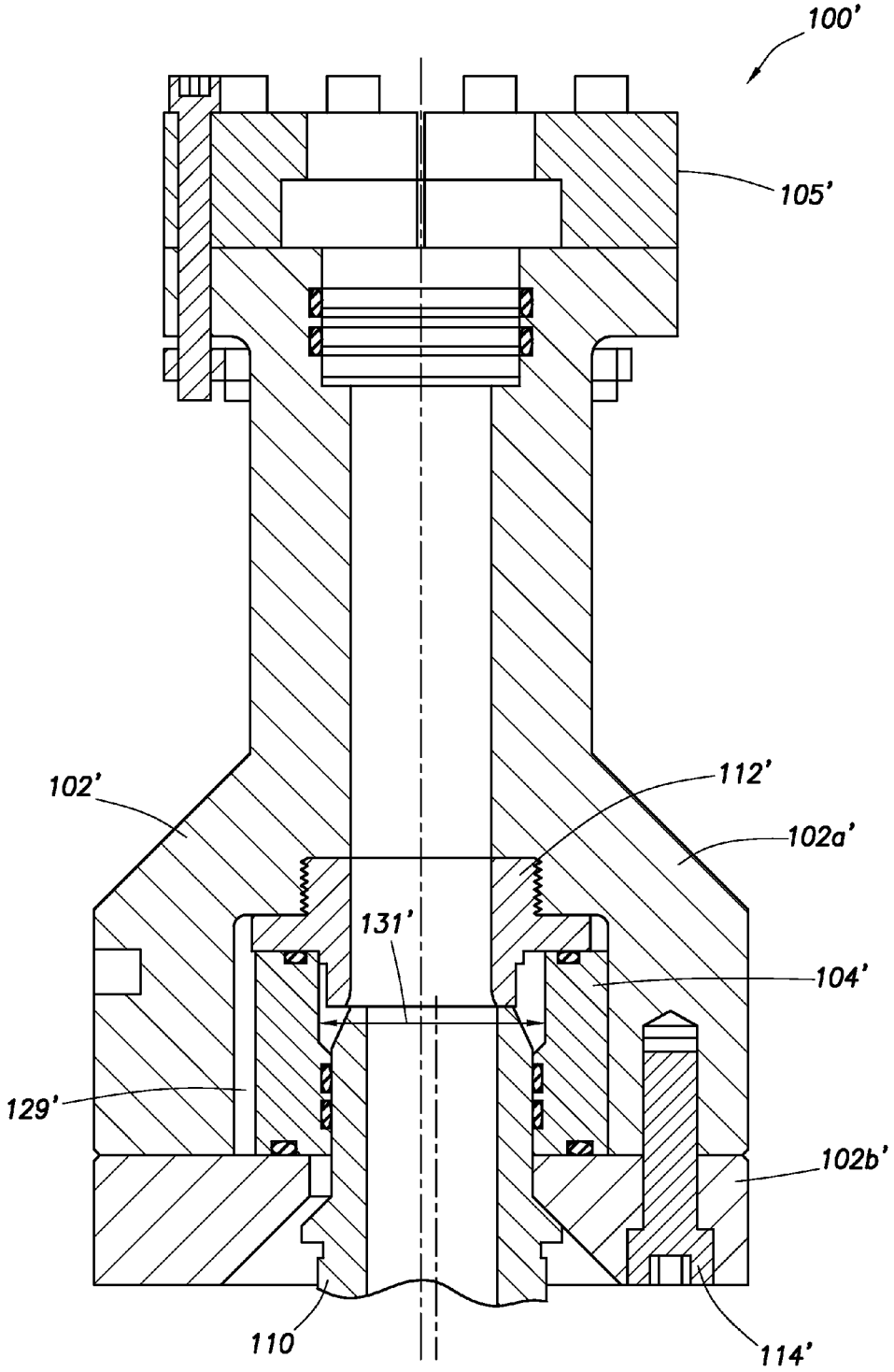
FIG. 3A is a cross-sectional side view of another embodiment of a female receiving connector in accordance with the invention.
Figure 3B:
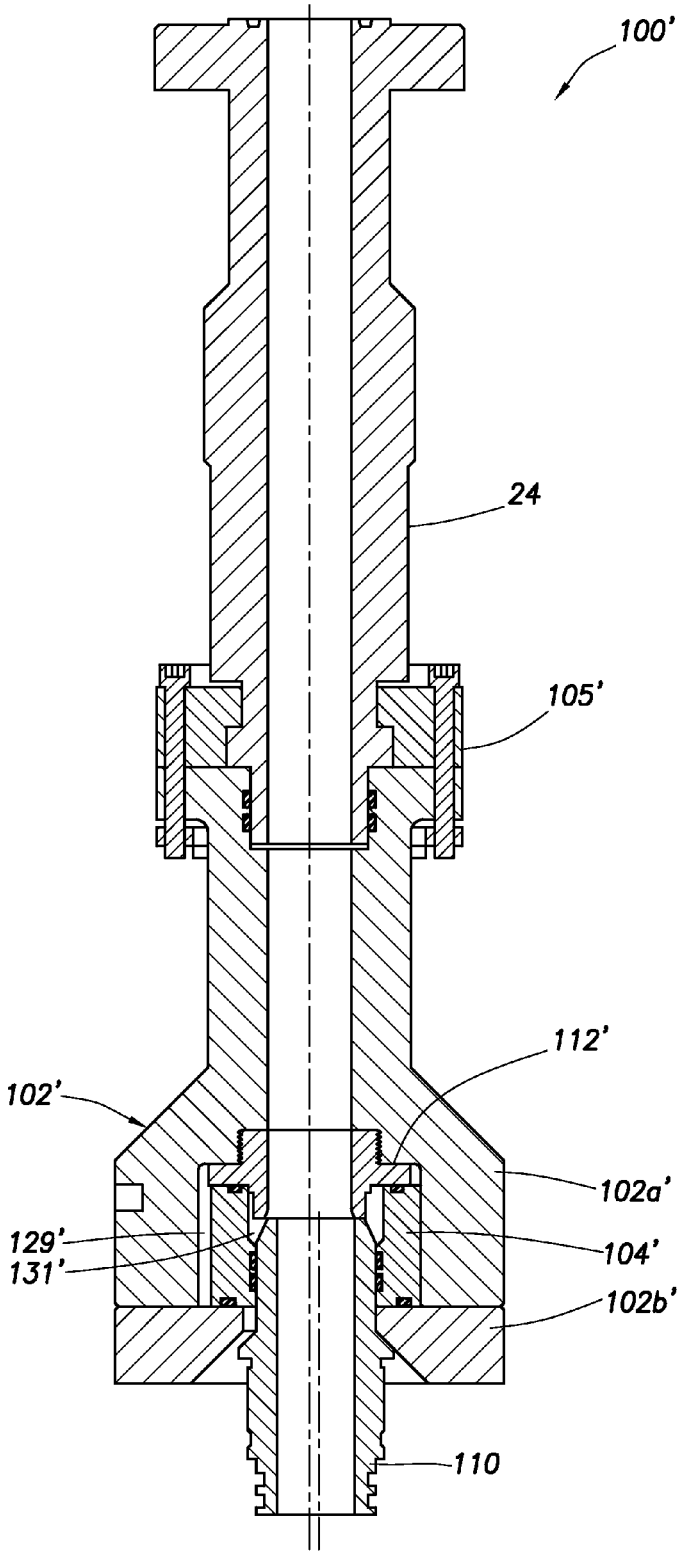
FIG. 3B is a cross-sectional view of the female receiving connector of FIG. 3A mated to a male stab connector in accordance with the invention.

FIGS. 3A and 3B show cross-sectional views of an alternate female connector 100' with male stab connector 110 received therein. The female connector 100' is similar to the female connector of FIGS. 2A-2C, except that the housing 102' includes an upper portion 102*a*' and lower portion 102*b*' in a different configuration connected by relocated fasteners 114'. A modified floating cartridge 104' and wear insert 112' are provided in a modified cavity 129' of the housing 102'. The male connector 110 is receivable by in cavity 129 of the housing and in diameter 131' of the floating cartridge 104'. In FIG. 3B, a more detailed clamp 105' is also depicted with the choke & kill line 25 connected thereto (FIG. 1).

Figure 4A:
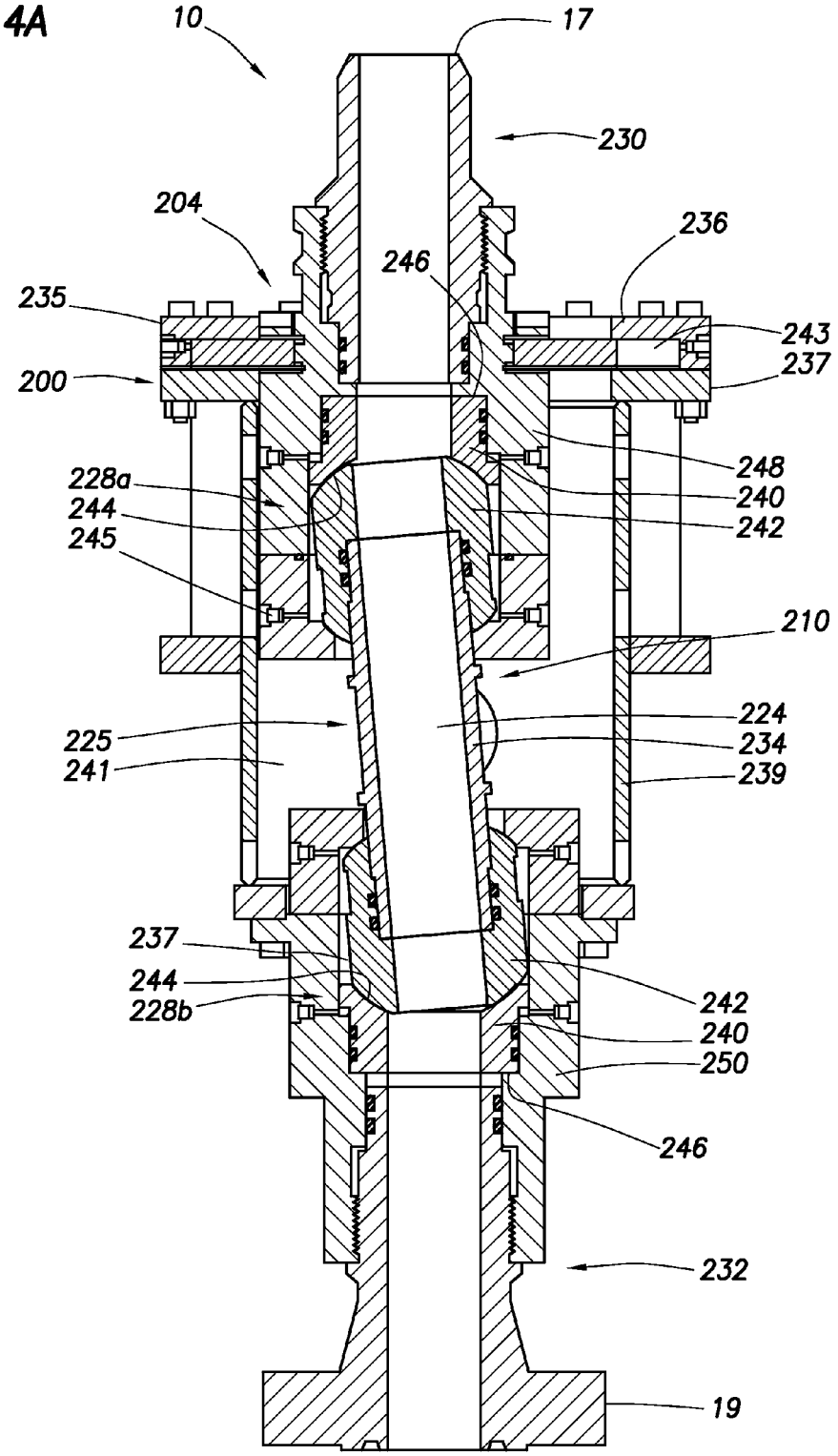
FIG. 4A is a cross-sectional side view of embodiments of a male stab connector and mated female receiving connector illustrated in accordance with the invention.
Figure 4B:
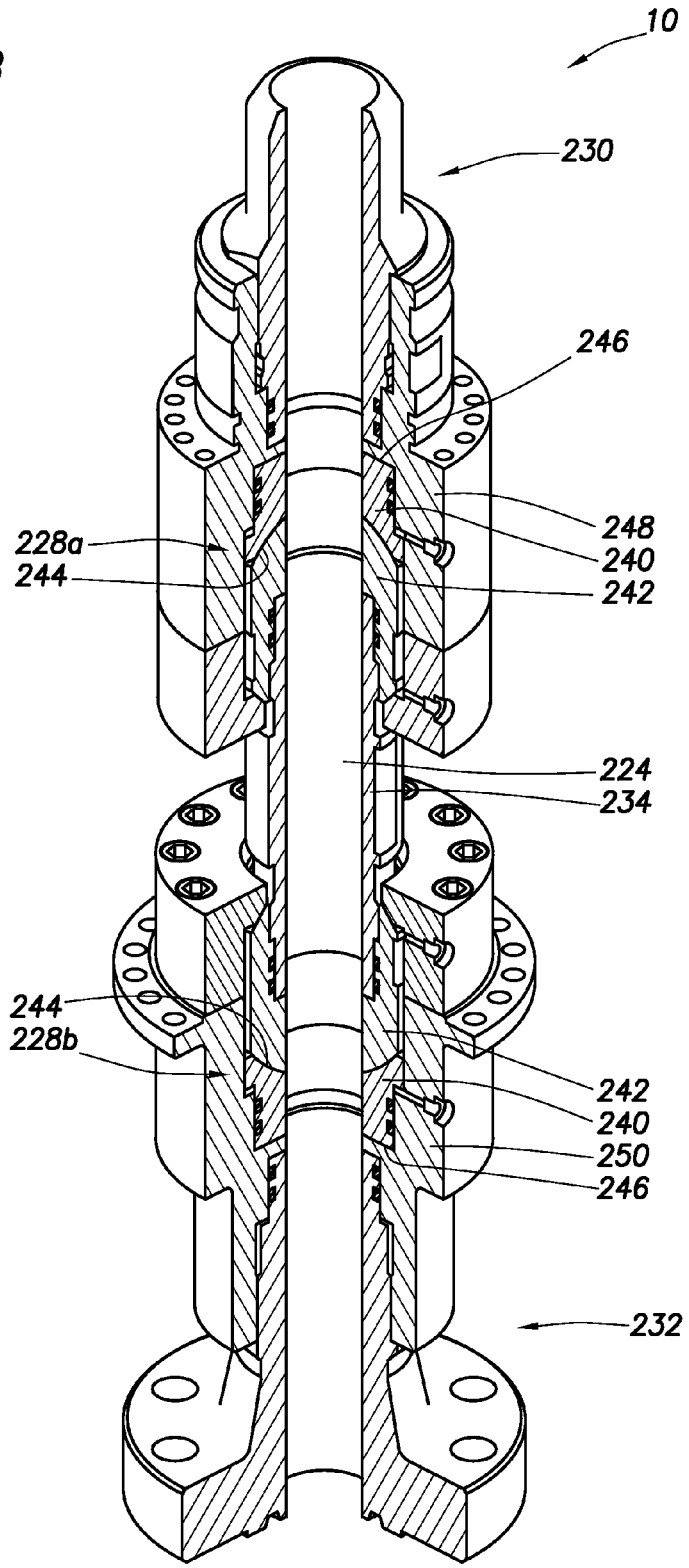
FIG. 4B is a cutaway perspective view of the male stab connector and female receiving connector illustrated in FIG. 5.

FIGS. 4A and 4B depict additional embodiments of the connection assembly 10. Referring to FIG. 4A, a cross-sectional side view of an embodiment of a connection assembly 10 in accordance with the disclosure is illustrated. FIG. 4B is a cutaway perspective view of the connection assembly 10 illustrated in FIG. 4A. In this embodiment, a male stab connector 210 has a pivotal joint 225 operatively connectable to a floating cartridge 204. The floating cartridge 204 is laterally movable in a female receiving connector 200. The male stab connector 210 extends into the female receiving connector 200 and is movable therein via the floating cartridge 204. The joint 225 of male stab connector 210 includes two spherical connections 228*a*, 228*b* at opposite ends thereof that enable movement of a movable portion 230 relative to a fixed portion 232 of the connection assembly 10.

In a given example, the female connector 200 may be fixed and the male connector 210 may be movable relative thereto via floating cartridge 204, and the reverse is also possible. In the example shown, a fixed portion 232 may be rigidly attached to a structure, such as a Lower Stack 19. A movable portion 230 may be connectable to a structure, such as LMRP 17, and move laterally and/or angularly to accommodate axial and/or angular misalignment of a female receiving connector 200 with respect thereto. A pivoting channel 234 between the spherical connections 228*a*, 228*b* may enable the lateral and/or angular movement of the movable portion 230. The amount of axial and/or angular misalignment that can be tolerated may depend on the length of the pivoting channel 234, the flexibility of the spherical connections 228*a*, 228*b*, as well as other factors.

In certain embodiments, a supporting structure (or housing) 236 of the female connector 200 may keep the movable portion 230 substantially parallel to the fixed portion 232 by restricting the movement of the movable portion to a parallel plane. The supporting structure 236 is shown as including an upper housing 237 and a lower housing 239 defining a cavity 241 therein. The cavity 241 receives a portion of the floatable (or floating) cartridge 248 and the male connector 210. The upper housing 237 has a hole therethrough. The floatable cartridge 248 has an end extending through the hole for connection to the structure 17. In certain embodiments, the supporting structure 236 could be designed to allow some angular motion of the movable portion 230 relative to the fixed portion 232, although the angular motion may be restricted to desired range.

The floatable cartridge 248 has a piston 235 thereabout that is slidably receivable in a chamber 243 in upper housing 237. The chamber 243 is defined to allow lateral, but restrict axial motion of the floating cartridge 248. The floating cartridge 248 has a joint cavity 245 therein for receiving spherical connector (or piston connector) 228*a*. Spherical connector (or component connector) 228*b* is operatively connectable to housing 250 for pivotal movement thereabout. The housing 250 may have a joint cavity 237 for receiving the spherical connector 228*b*.

In the illustrated embodiment, each spherical connection 228*a*, 228*b* includes a conical socket 240 that pivots relative to a sphere 242. A seal 244 prevents fluid from passing between the conical socket 240 and the sphere 242. On the other hand, fluid may be allowed to enter interfaces 246 between the conical socket 240 and housing 248 of movable portion 230 and housing 250 of fixed portion 232. This will allow hydraulic pressure within the central bore 224 to enter the interfaces 246 and press the conical sockets 240 against the spheres 242, thereby improving the seal therebetween. Thus, the seals between the sockets 240 and spheres 242 may be "self-energized." Increasing the pressure in the central bore 224 may improve the seal between the conical sockets 240 and spheres 242.

Figure 5:
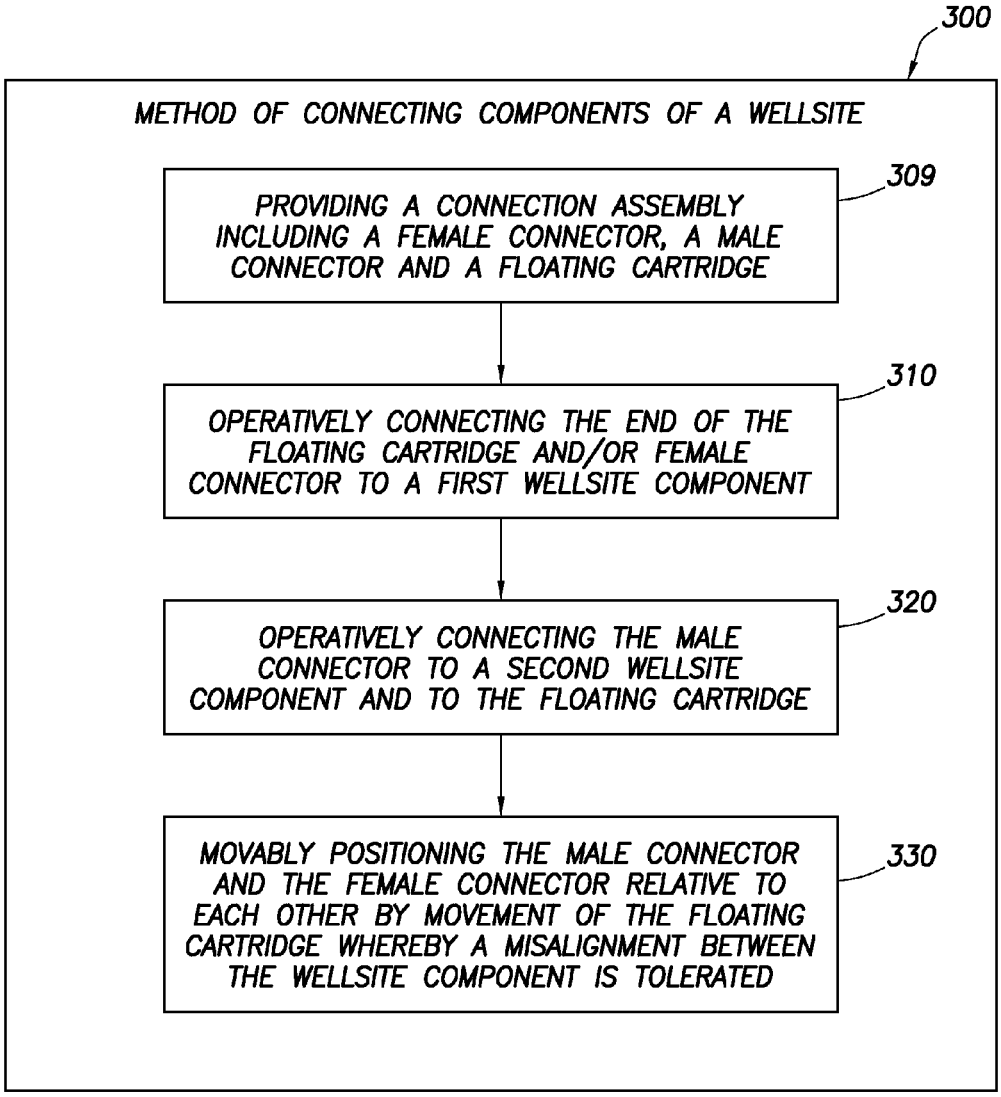
FIG. 5 is a method flow chart depicting a method of connecting wellsite components.

FIG. 5 depicts a method 300 of connecting components of a wellsite. The method involves 309 providing a connection assembly, such as those described herein. The method also involves 310 operatively connecting the end of the floating cartridge and/or the female connector to a first wellsite component, 320 operatively connecting the male connector to a second wellsite component and to the floating cartridge, and 330 movably positioning the male connector and the female connector relative to each other by movement of the floating cartridge whereby a misalignment between the wellsite components is tolerated.

The female or the male connector may be fixed, with the other movable relative thereto. The method may be performed in any order and repeated as desired.

The present disclosure may be embodied in other specific forms without departing from its spirit or essential characteristics. The described embodiments are to be considered in all respects only as illustrative and not restrictive. The scope of the disclosure is, therefore, indicated by the appended claims, or claims added to this disclosure at a future point in time, rather than by the foregoing description. All changes which come within the meaning and range of equivalency of the claims are to be embraced within their scope.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the disclosure whose scope is to be determined from the literal and equivalent scope of the claims which follow.

While the embodiments are described with reference to various implementations and exploitations, it will be understood that these embodiments are illustrative and that the scope of the inventive subject matter is not limited to them. Many variations, modifications, additions and improvements are possible. For example, one or more connection assemblies and/or components may be connected. Various combinations of features of the various connectors and/or assemblies may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A connection assembly for connecting components of a well site, the well site having a wellbore extending into a subsurface formation, the connection assembly comprising:

a female connector housing having an end operatively connectable to a first of the components and a cavity therein formed by the housing between an upper surface and a lower surface;

a removable wear insert positionable in the cavity and connected to an inner diameter of the female connector housing, the removable wear insert including a central fluid bore;

a floating cartridge positionable in the cavity of the female connector housing and laterally movable therein, wherein the removable wear insert and the floating cartridge are retained together in the cavity between the upper surface and the lower surface formed by the female connector housing; and a male connector including a central fluid bore and operatively connectable to a second of the components, the male connector receivable in the cavity of the female connector housing and operatively connectable to the floating cartridge such that the male connector and the female connector housing are movably positionable relative to each other by the floating cartridge whereby a misalignment between the well site components is tolerated, and the central fluid bores of the removable wear insert and the male connector are in fluid communication for the passage of fluid therethrough.

2. The connection assembly of claim 1, wherein the female connector housing comprises a bore therethrough in communication with the first of the components.

3. The connection assembly of claim 2, wherein the female connector housing comprises an upper housing and a lower housing having an interface therebetween.

4. The connection assembly of claim 3, wherein the floating cartridge is positionable in one of the upper and lower housings.

5. The connection assembly of claim 1, wherein the male connector central fluid bore is in fluid communication with the second of the components.

6. The connection assembly of claim 5, wherein the female connector housing has a bore therethrough in fluid communication with the first of the components and the central fluid bore of the male connector.

7. The connection assembly of claim 6, wherein the wear insert central fluid bore is in fluid communication with the bore of the female connector housing and the central fluid bore of the male connector.

8. The connection assembly of claim 1, wherein the floating cartridge has an outer diameter smaller than an inner diameter of a lower housing.

9. The connection assembly of claim 1, wherein the male connector has an outer diameter positionable adjacent an inner diameter of the floating cartridge.

10. The connection assembly of claim 1, wherein opposite ends of the floating cartridge are positionable in the cavity of the female connector housing and against an inner wall of the female connector housing to restrict axial movement thereof.

11. The connection assembly of claim 10, wherein an end of the floating cartridge is positionable against the wear insert to restrict the axial movement thereof.

12. The connection assembly of claim 1, further comprising at least one seal.

13. The connection assembly of claim 1, wherein one of the female connector housing and an end of the male connector is fixed and wherein another of the female connector housing and the end of the male connector is movable.

14. A well site system for connecting components of a well site, the well site having a wellbore extending into a subsurface formation, the well site system comprising:

a first well site component;

a second well site component; and a connection assembly, comprising:

a female connector having an end operatively connectable to a first of the components and a cavity extending therein;

a removable wear insert positionable in the cavity and affixed to an inner diameter of the female connector;

a floating cartridge positionable in the cavity of the female connector and laterally movable therein, the floating cartridge axially restricted between the wear insert and the female connector to prevent longitudinal motion of the floating cartridge in the cavity of the female connector; and a male connector operatively connectable to the second well site component, the male connector receivable in the cavity of the female connector and operatively connectable to the floating cartridge such that the male connector and the female connector are movably positionable relative to each other by the floating cartridge whereby a misalignment between the well site components is tolerated.

15. The well site system of claim 14, wherein the well site components comprise choke and kill lines, a low marine riser pump, a blowout preventer, a riser and combinations thereof.

16. A method of connecting components of a wellsite, the wellsite having a wellbore extending into a subsurface formation, the method comprising:

providing a connection assembly comprising:

a female connector housing having an end operatively connectable to a first of the components and a cavity therein formed by the housing between an upper surface and a lower surface;

a removable wear insert positionable in the cavity and connected to an inner diameter of the female connector housing, the removable wear insert including a central fluid bore;

a floating cartridge positioned in the cavity of the female connector housing and laterally movable therein, wherein the removable wear insert and the floating cartridge are retained together in the cavity between the upper surface and lower surface formed by the female connector housing; and a male connector including a central fluid bore and operatively connectable to a second of the components, the male connector receivable in the cavity of the female connector and operatively connectable to the floating cartridge;

operatively connecting the end of the female connector to the first of the components and the male connector to the second of the components;

operatively connecting an end of the male connector to the floating cartridge in the female connector thereby fluidicly coupling the central fluid bores of the removable wear insert and the male connector; and movably positioning the male connector and the female connector relative to each other by movement of the floating cartridge whereby a misalignment between the well site components is tolerated.

17. The method of claim 16, further comprising providing at least one seal about one of the female connector housing, the male connector, the floating cartridge and combinations thereof.

18. A connection assembly for connecting components of a well site, the well site having a wellbore extending into a subsurface formation, the connection assembly comprising:

a female connector housing having an end operatively connectable to a first of the components and a cavity therein formed by the housing between an upper surface and a lower surface;

a removable wear insert positionable in the cavity and affixed to an inner diameter of the female connector housing;

a floating cartridge positionable in the cavity of the female connector housing and laterally movable therein, wherein the removable wear insert and the floating cartridge are retained together in the cavity between the upper surface and the lower surface formed by the female connector housing; and a male connector operatively connectable to a second of the components, the male connector receivable in the cavity of the female connector housing and operatively connectable to the floating cartridge such that the male connector and the female connector housing are movably positionable relative to each other by the floating cartridge whereby a misalignment between the well site components is tolerated;

wherein the male connector is disposed axially adjacent the removable wear insert.

19. The connection assembly of claim 18 wherein the removable wear insert prevents axial passage of the male connector.

20. A connection assembly for connecting components of a well site, the well site having a wellbore extending into a subsurface formation, the connection assembly comprising:

a female connector housing having an end operatively connectable to a first of the components and a cavity therein formed by the housing between an upper surface and a lower surface;

a removable wear insert positionable in the cavity and threadedly connected to an inner diameter of the female connector housing;

a floating cartridge positionable in the cavity of the female connector housing and laterally movable therein, wherein the removable wear insert and the floating cartridge are retained together in the cavity between the upper surface and the lower surface formed by the female connector housing; and a male connector operatively connectable to a second of the components, the male connector receivable in the cavity of the female connector housing and operatively connectable to the floating cartridge such that the male connector and the female connector housing are movably positionable relative to each other by the floating cartridge whereby a misalignment between the well site components is tolerated.

21. The connection assembly of claim 20 wherein a threaded coupling of the removable wear insert and the female connector housing is axially spaced from the male connector.

* * * * *